US007922028B2

(12) United States Patent
Baltz

(10) Patent No.: US 7,922,028 B2
(45) Date of Patent: Apr. 12, 2011

(54) PAIL WITH LID AND FLASHED LIP

(75) Inventor: Kyle L. Baltz, Redondo Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 6 days.

(21) Appl. No.: 12/392,642

(22) Filed: Feb. 25, 2009

(65) Prior Publication Data

US 2010/0213195 A1 Aug. 26, 2010

(51) Int. Cl.
*B65D 1/42* (2006.01)

(52) U.S. Cl. ..... 220/657; 220/659; 220/780

(58) Field of Classification Search ..... 220/657, 220/659, 675, 780, 782
See application file for complete search history.

(56) References Cited

U.S. PATENT DOCUMENTS

| | | | | |
|---|---|---|---|---|
| 3,463,340 | A | | 8/1969 | Lindstrom |
| 3,642,167 | A | | 2/1972 | Kinney |
| 3,759,415 | A | | 9/1973 | Cloyd |
| 3,770,156 | A | | 11/1973 | Yates, Jr. |
| 3,817,420 | A | | 6/1974 | Heisler |
| 4,210,258 | A | | 7/1980 | von Holdt |
| 4,256,240 | A | | 3/1981 | Woinarski |
| 4,293,080 | A | | 10/1981 | Letica |
| 4,296,871 | A | | 10/1981 | Andersson |
| 4,305,517 | A | | 12/1981 | Dennis |
| 4,356,930 | A | | 11/1982 | Roper |
| 4,453,646 | A | | 6/1984 | Harrild |
| 4,457,447 | A | | 7/1984 | Kirkis |
| 4,518,097 | A | | 5/1985 | Milton et al. |
| 4,524,882 | A | | 6/1985 | Buc |
| 4,560,077 | A | | 12/1985 | Dutt |
| 4,566,601 | A | | 1/1986 | Kuenzig |
| 4,577,776 | A | | 3/1986 | Rayner et al. |
| 4,632,265 | A | | 12/1986 | Cochrane |
| 4,658,977 | A | | 4/1987 | Crisci |
| 4,660,735 | A | | 4/1987 | Peschardt et al. |
| 4,667,843 | A | | 5/1987 | Galer |
| 4,711,364 | A | | 12/1987 | Letica |
| 4,735,337 | A | | 4/1988 | Von Holdt |
| 4,815,620 | A | | 3/1989 | Bullock, III |
| 4,836,407 | A | | 6/1989 | Bruce et al. |
| 4,881,658 | A | * | 11/1989 | VanCucha ..... 220/792 |
| 4,887,735 | A | | 12/1989 | Dudzik |
| 4,930,656 | A | | 6/1990 | Blanchette |
| 4,961,512 | A | | 10/1990 | Von Holdt |

(Continued)

FOREIGN PATENT DOCUMENTS

| | | |
|---|---|---|
| CA | 2 060 982 | 11/2004 |

(Continued)

OTHER PUBLICATIONS

European Search Report for EP Application No. 10154735.4, May 20, 2010.

*Primary Examiner* — Anthony Stashick
*Assistant Examiner* — Harry A Grosso
(74) *Attorney, Agent, or Firm* — Carlson, Gaskey & Olds

(57) ABSTRACT

A pail includes a base and at least one wall extending upwardly from a periphery of the base to an opening of the pail. A lip protruding outwardly from an upper edge of the at least one wall includes a plurality of flanges. A lid located adjacent the plurality of flanges.

18 Claims, 10 Drawing Sheets

U.S. PATENT DOCUMENTS

| | | | | |
|---|---|---|---|---|
| 4,984,701 | A | | 1/1991 | Margaria |
| 5,046,632 | A | | 9/1991 | Bordner |
| 5,097,977 | A | | 3/1992 | Straub |
| 5,125,530 | A | | 6/1992 | Straub |
| 5,238,135 | A | | 8/1993 | Landis |
| 5,328,047 | A | | 7/1994 | Smith |
| 5,377,858 | A | | 1/1995 | Morris, Sr. |
| 5,460,287 | A | | 10/1995 | Cargile et al. |
| 5,536,161 | A | | 7/1996 | Smith |
| 5,538,154 | A | * | 7/1996 | Von Holdt ..... 220/277 |
| 5,626,251 | A | | 5/1997 | Luburic et al. |
| 5,730,309 | A | | 3/1998 | Jiradejnunt et al. |
| 5,873,484 | A | | 2/1999 | Clute et al. |
| 6,279,774 | B1 | | 8/2001 | Clute et al. |
| 6,325,226 | B1 | | 12/2001 | Krautkramer |
| 6,435,384 | B1 | | 8/2002 | Davis et al. |
| 6,543,635 | B2 | | 4/2003 | Ciccone |
| 6,619,498 | B2 | | 9/2003 | von Holdt, Jr. |
| 6,779,676 | B2 | | 8/2004 | Ciccone |
| 6,845,877 | B2 | | 1/2005 | Diesterbeck |
| 7,086,551 | B2 | | 8/2006 | von Holdt, Jr. |
| 7,090,088 | B2 | | 8/2006 | von Holdt, Jr. |
| 7,207,457 | B2 | | 4/2007 | Schwarz |
| 2007/0205196 | A1 | | 9/2007 | Burney et al. |

FOREIGN PATENT DOCUMENTS

| | | |
|---|---|---|
| DE | 295 15 093 U1 | 11/1995 |
| EP | 2 130 777 A2 | 12/2009 |

* cited by examiner

PAIL WITH LID AND FLASHED LIP

BACKGROUND OF THE INVENTION

Pails are often used to ship and sell products to consumers. The pails include a base and a side wall extending upwardly from a periphery of the base. At an open end of the pail, a lip may be formed for retaining a lid thereon. Further, the pail may include one or more reinforcing rings protruding outwardly from the side of the side wall.

Many pails include lids that snap down over a lip at the open end of the pail. The lids may include a tear away portion around the periphery of the lid. The tear away portion prevents the lid from being removed until the tear away portion is torn away from the rest of the lid. The latch portions permit the lid to be removably re-secured to the pail.

SUMMARY OF THE INVENTION

A pail according to one embodiment of the present invention includes a base and at least one wall extending upwardly from a periphery of the base to an opening of the pail. A lip protruding outwardly from an upper edge of the at least one wall and a plurality of flanges extending from the lip and a lid located adjacent the plurality of flanges.

The pail is sealed by placing the lid on the upper edge of the pail and biasing the lid against at least one flange located on the upper edge of the pail.

These and other features of the application can be best understood from the following specification and drawings, the following of which is a brief description.

DETAILED DESCRIPTION OF THE PREFERRED EMBODIMENT

Figure 1:
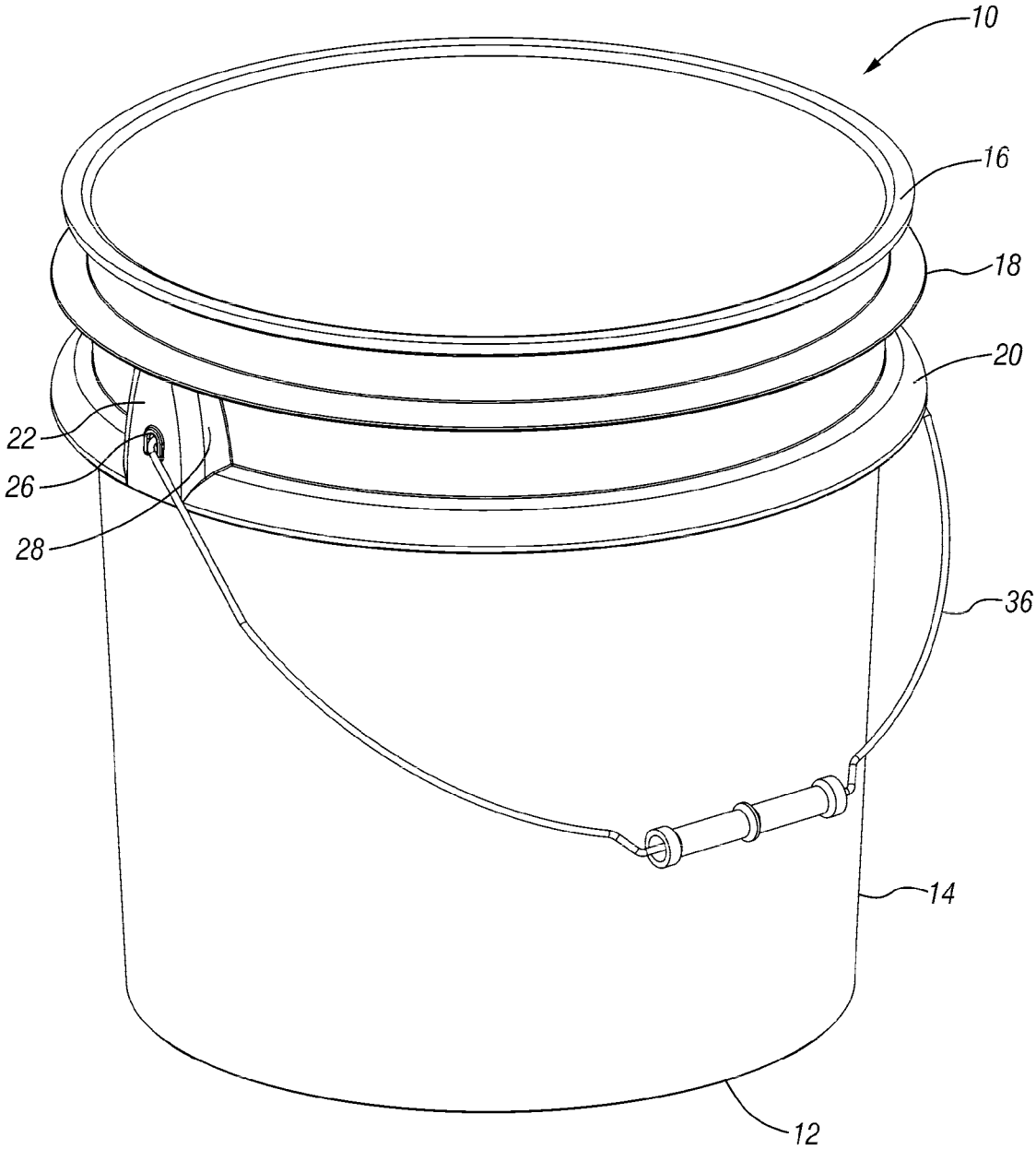
FIG. 1 is a perspective view of a pail according to one embodiment of the present invention.

A pail 10 according to one embodiment of the present invention is shown in FIG. 1. The pail 10 includes a base 12 and a side wall 14 extending upwardly from the outer periphery of the base 12. At the open end of the pail 10, a lip 16 protrudes outwardly from an upper edge of the side wall 14. Spaced below the lip 16, a mid-ring 18 protrudes outwardly from the side wall 14. Spaced below the mid-ring 18, a skirt 20 curves outwardly and downwardly from an outer surface of the side wall 14.

A pair of handle attachment walls 22 (one shown in FIG. 1) are spaced outwardly of the side wall 14 and generally parallel thereto, or, more specifically, tangential thereto. The handle attachment wall 22 may include an aperture 26 for attaching a wire handle 36. Curved side walls 28 enclose the handle attachment wall 22. The handle attachment wall 22 extends from the skirt 20 to the mid-ring 18.

Figure 2:
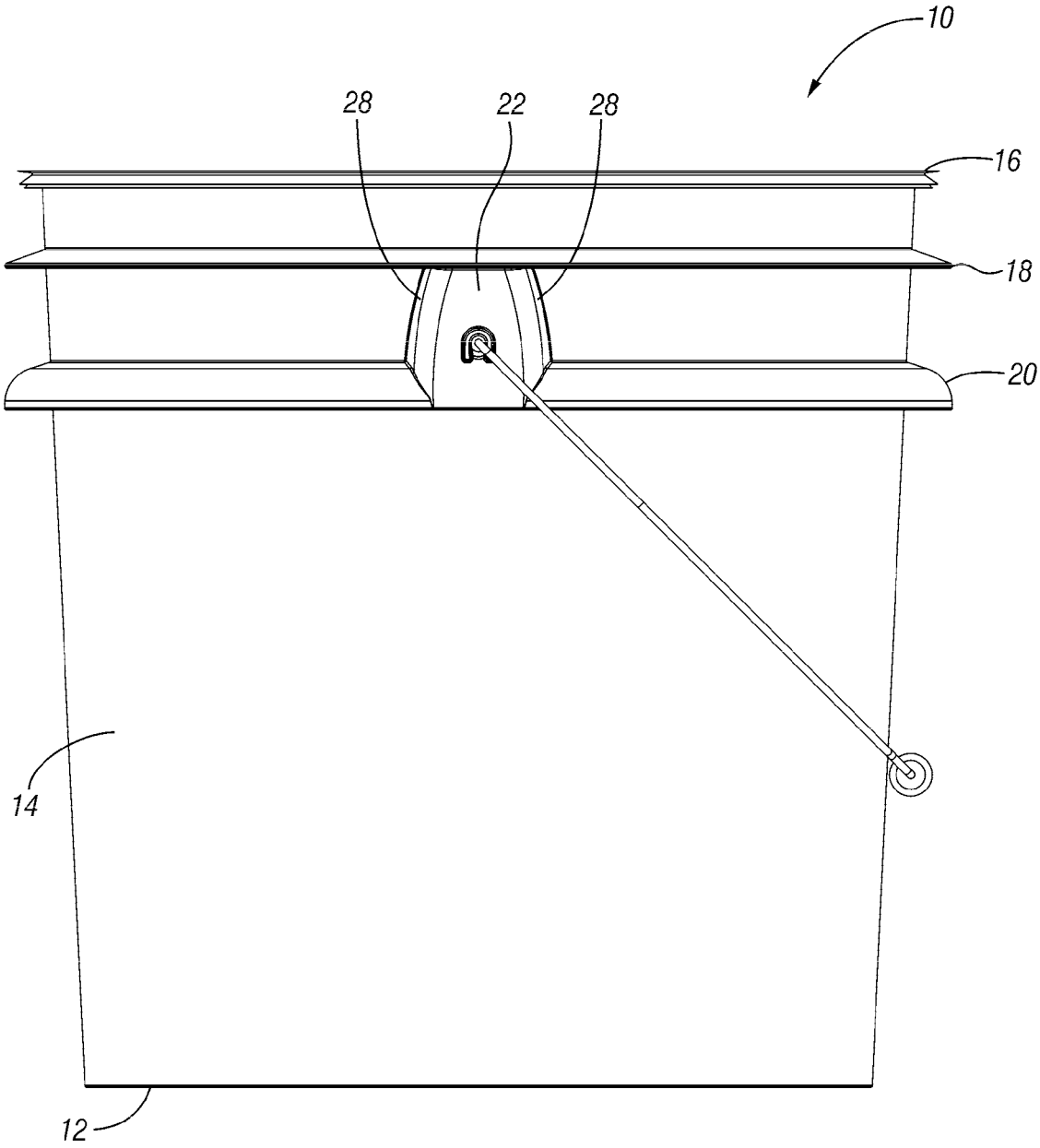
FIG. 2 is a side view of the pail of FIG. 1.

Referring to FIG. 2, the handle attachment wall 22 extends downwardly to the lower most edge of the skirt 20 and upwardly to the mid-ring 18. This reinforces the handle attachment wall 22, the mid-ring 18 and the skirt 20. The handle attachment wall 22 is tapered toward the upper end of the handle attachment wall 22. The side walls 28 extend from the skirt 20 to the mid-ring 18 and also curve inwardly at the top of the handle attachment wall 22. The lip 16, the mid-ring 18, and the skirt 20 all contribute to the rigidity of the side wall 14 and help it maintain a circular cross-section.

Figure 3:
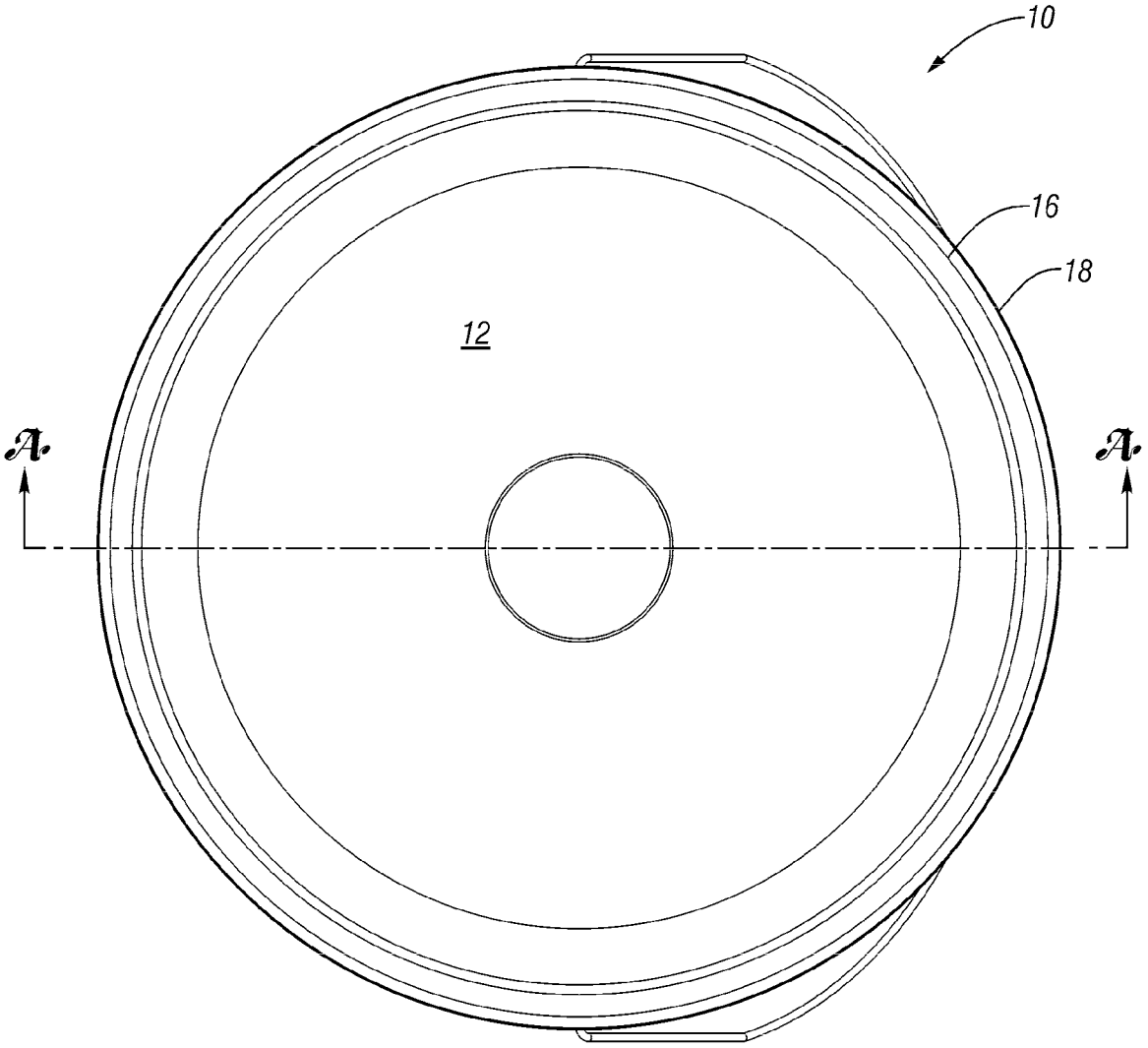
FIG. 3 is a top view of the pail of FIG. 1.

FIG. 3 is a top view of the pail 10.

Figure 4:
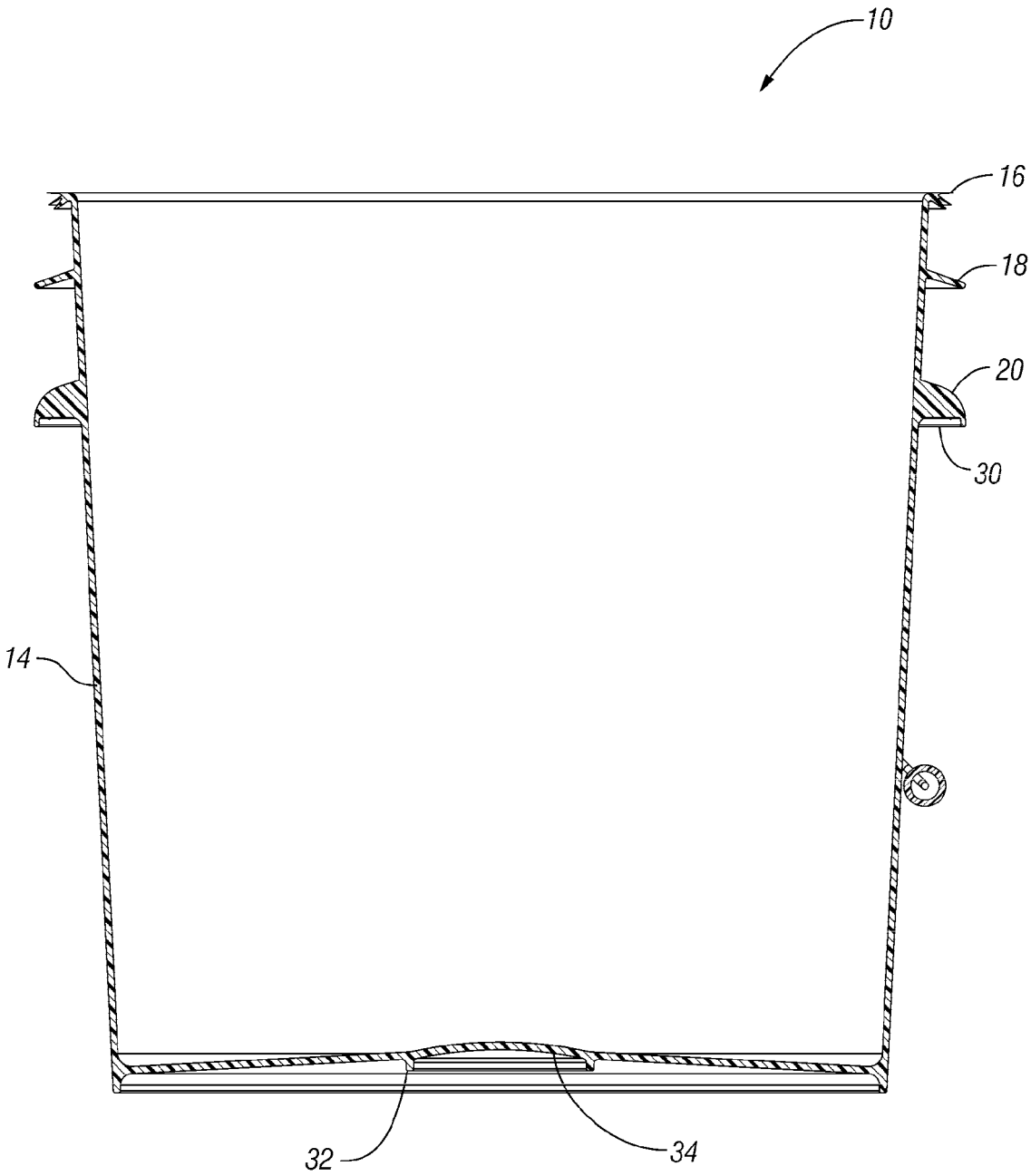
FIG. 4 is a section view taken along line A-A of FIG. 3.

FIG. 4 is a section view of the pail 10 taken along line A-A of FIG. 3. As shown, the mid-ring 18 is angled downwardly as it protrudes outwardly from the outer surface of the side wall 14. The skirt 20 generally has an outer surface that is rounded and curved. Ribs 30, perpendicular to the side wall 14, extend between the side wall 14 and the skirt 20 to reinforce the skirt 20. The base 12 is slightly bowed upward toward the center and includes an annular lip 32 protruding downwardly from the lower surface of the base 12, thereby defining a lower recess 34.

Figure 5:
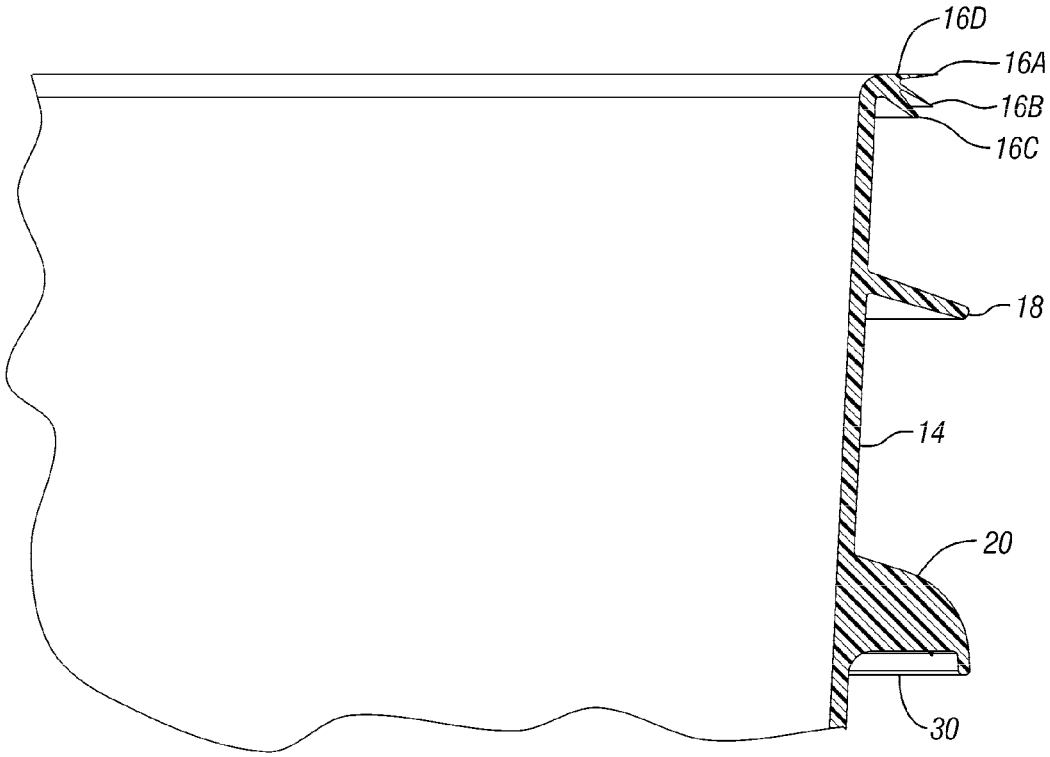
FIG. 5 is an enlarged view of a portion of FIG. 4.

FIG. 5 is an enlarged view of a portion of FIG. 4. The lip 16 includes an annular portion 16*d* and a plurality of flanges 16*a*, 16*b*, and 16*c*. The plurality of flanges 16*a*, 16*b*, and 16*c* extend radially outward from the annular portion 16*d*. In this example, the flanges 16*a* and 16*b* are substantially flexible and the flange 16*c* is substantially rigid. The flange 16*a* extends generally perpendicular to the side wall 14. Flanges 16*b* and 16*c* extend generally downward from the lip 16. The flanges 16*a*, 16*b*, and 16*c* are tapered toward a radially outer edge. The flange 16*c* is generally thicker than the flanges 16*a* and 16*b*. Although the lip 16 and flanges 16*a*, 16*b*, 16*c*, and annular portion 16*d* are shown with the pail 10, it is understood that the lip 16 and flanges 16*a*, 16*b*, 16*c*, and annular portion 16*d* could be used with any pail structure.

Figure 6:
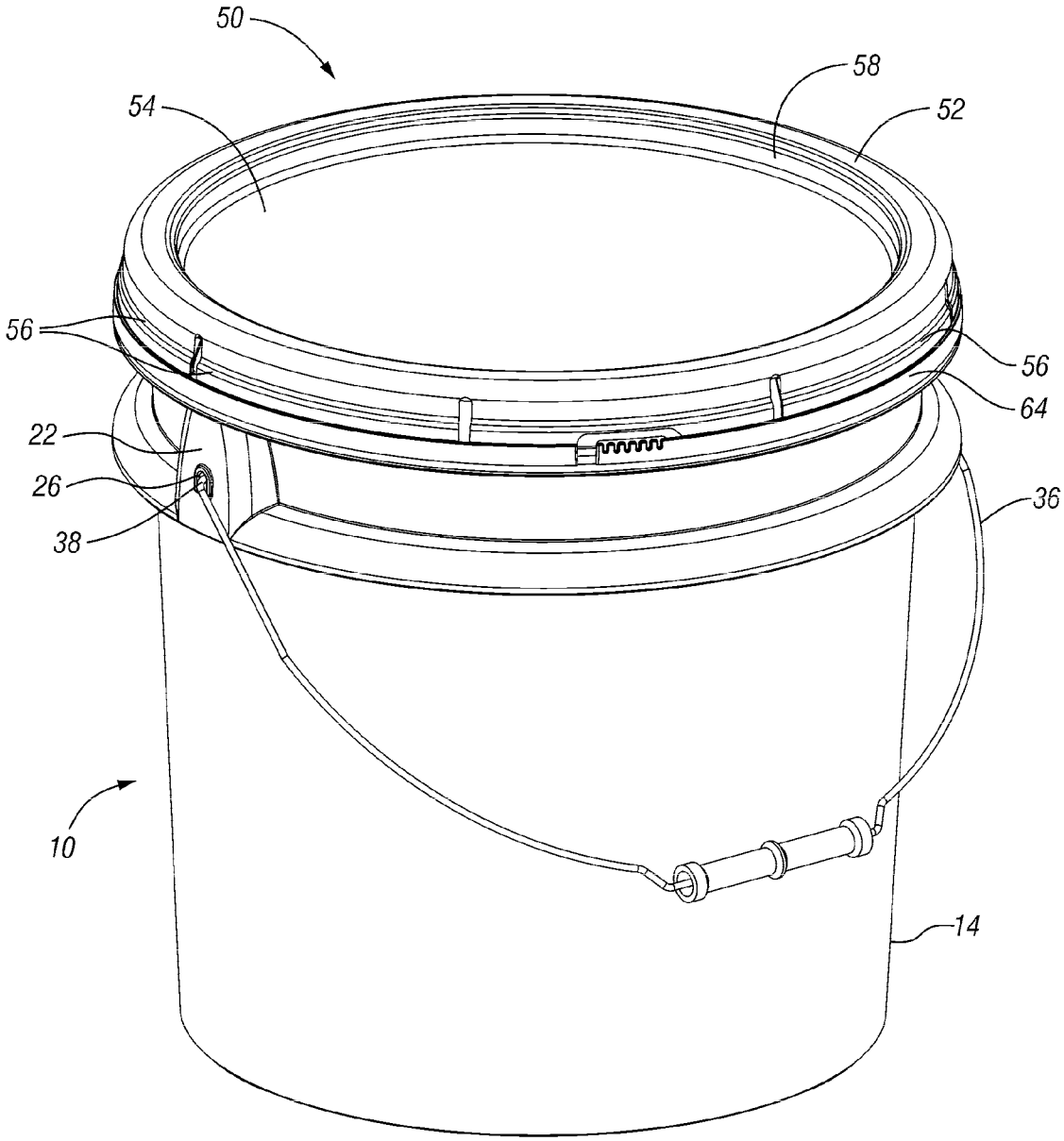
FIG. 6 illustrates the pail of FIG. 1 with a lid.
Figure 7:
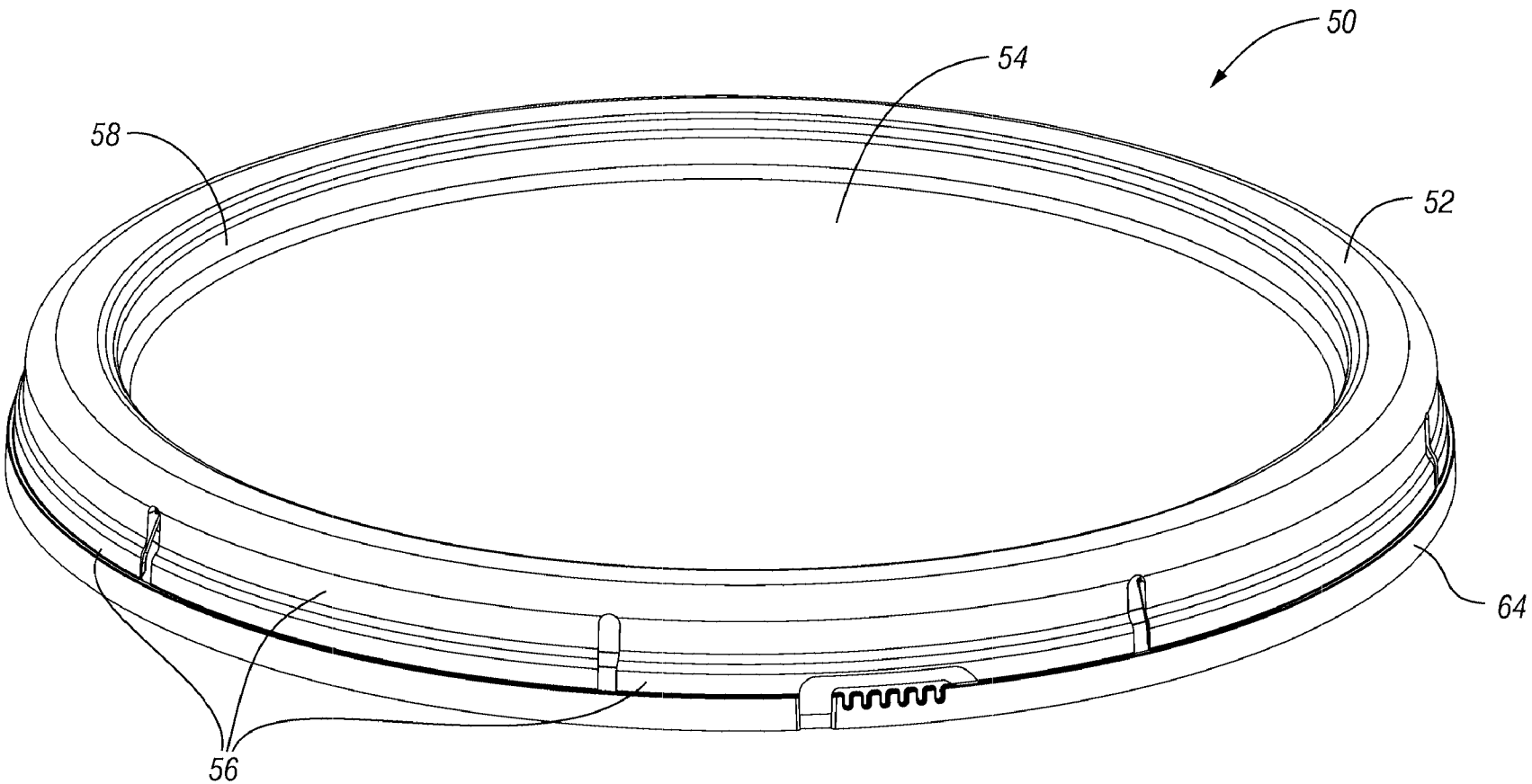
FIG. 7 illustrates a perspective view of the lid of FIG. 6.

FIG. 6 illustrates the pail 10 of FIG. 1 with a lid 50. FIG. 7 illustrates a perspective view of the lid 50 of FIG. 6. The lid 50 includes an annular upper wall 52 and a circular lower wall 54. An inner annular lip 58 protrudes downwardly from an inner circumference of the annular upper wall 52 to connect the annular upper wall 52 to the circular lower wall 54. The lid 50 further includes a plurality of latch portions 56 extending downwardly from the annular upper wall 52. A tear-away strip 64 connects each latch portion 56 to one another.

Figure 8:
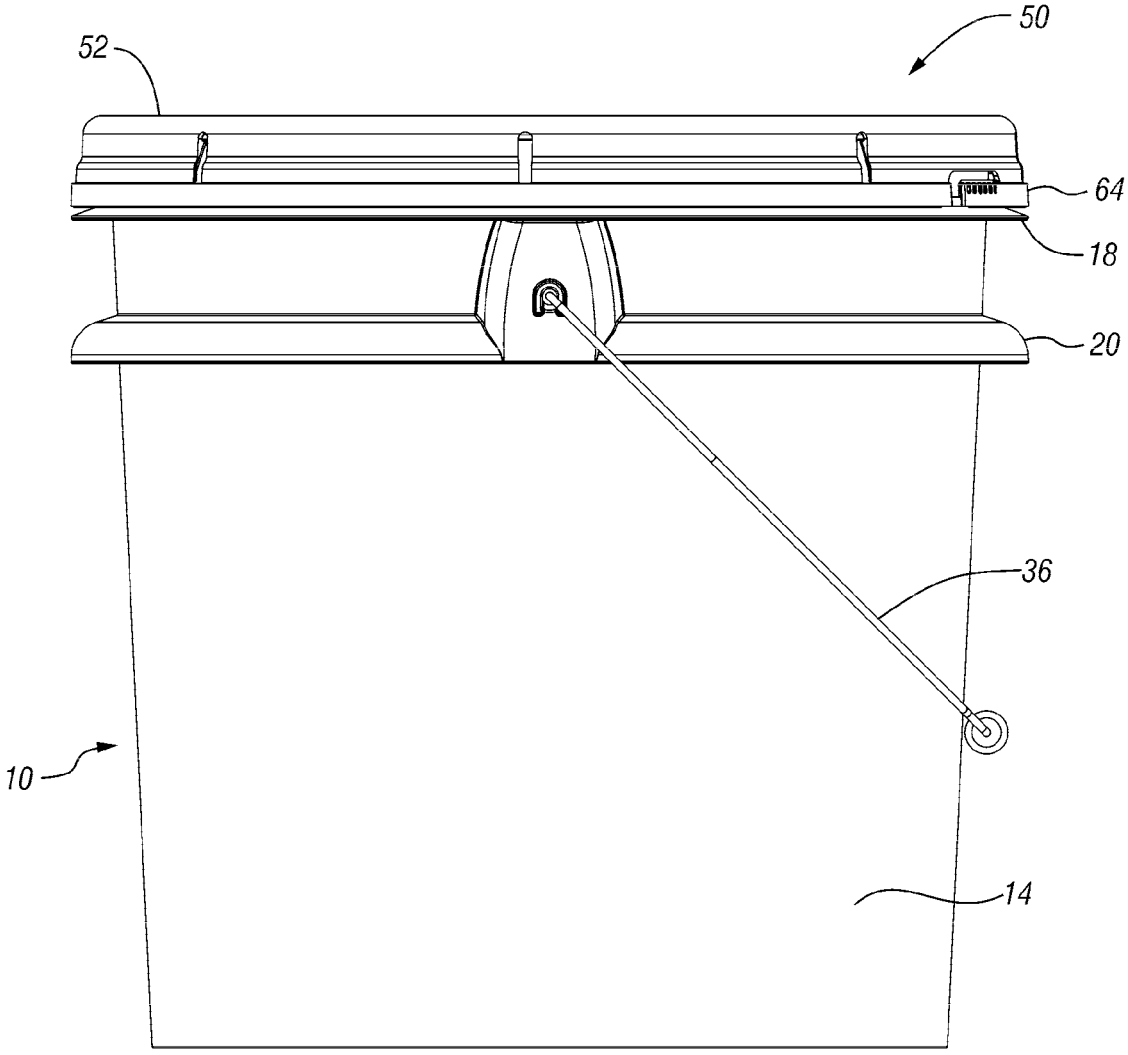
FIG. 8 is a side view of the pail of FIG. 6.
Figure 9:
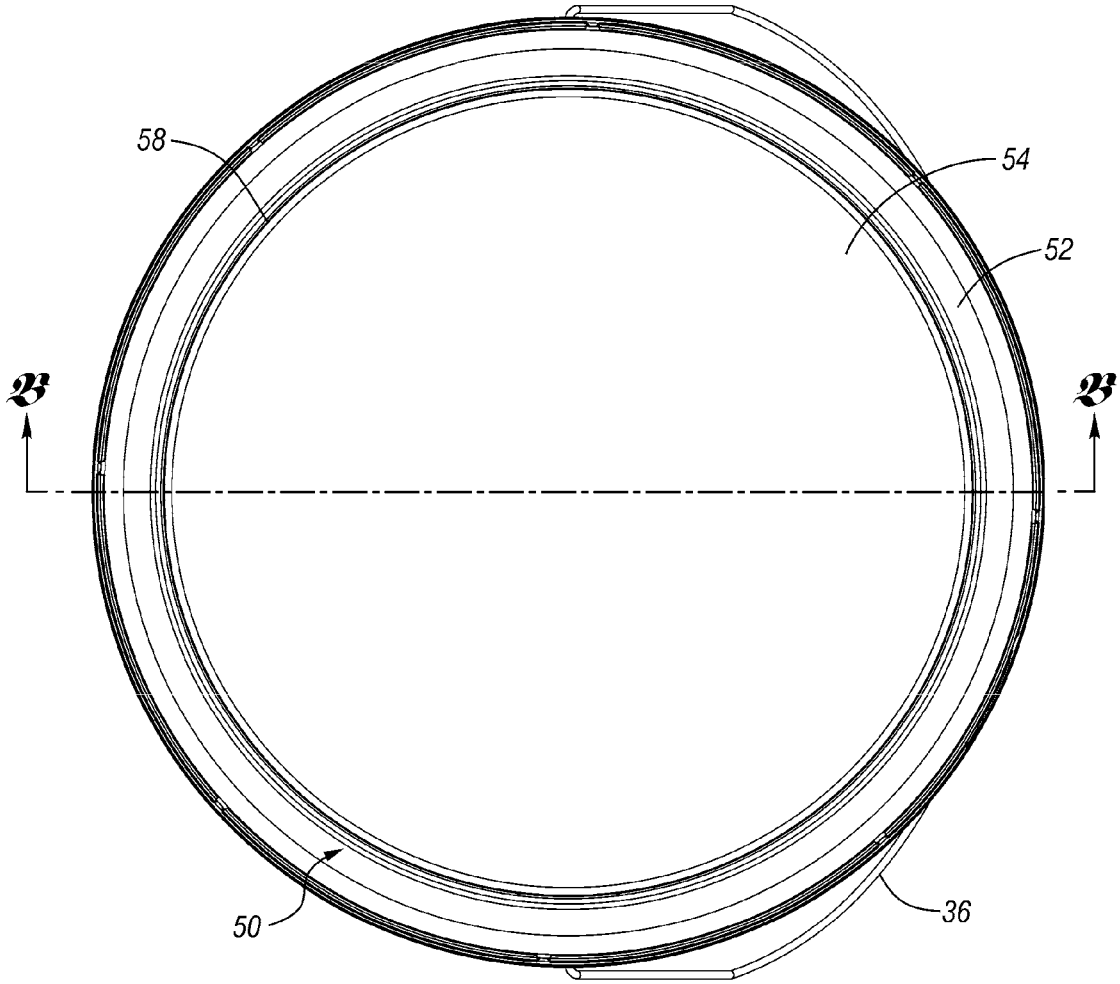
FIG. 9 is a top view of the pail of FIG. 6.

FIG. 8 is a side view of the lid 50 on the pail 10. FIG. 9 is a top view of the lid 50 on the pail 10.

Figure 10:
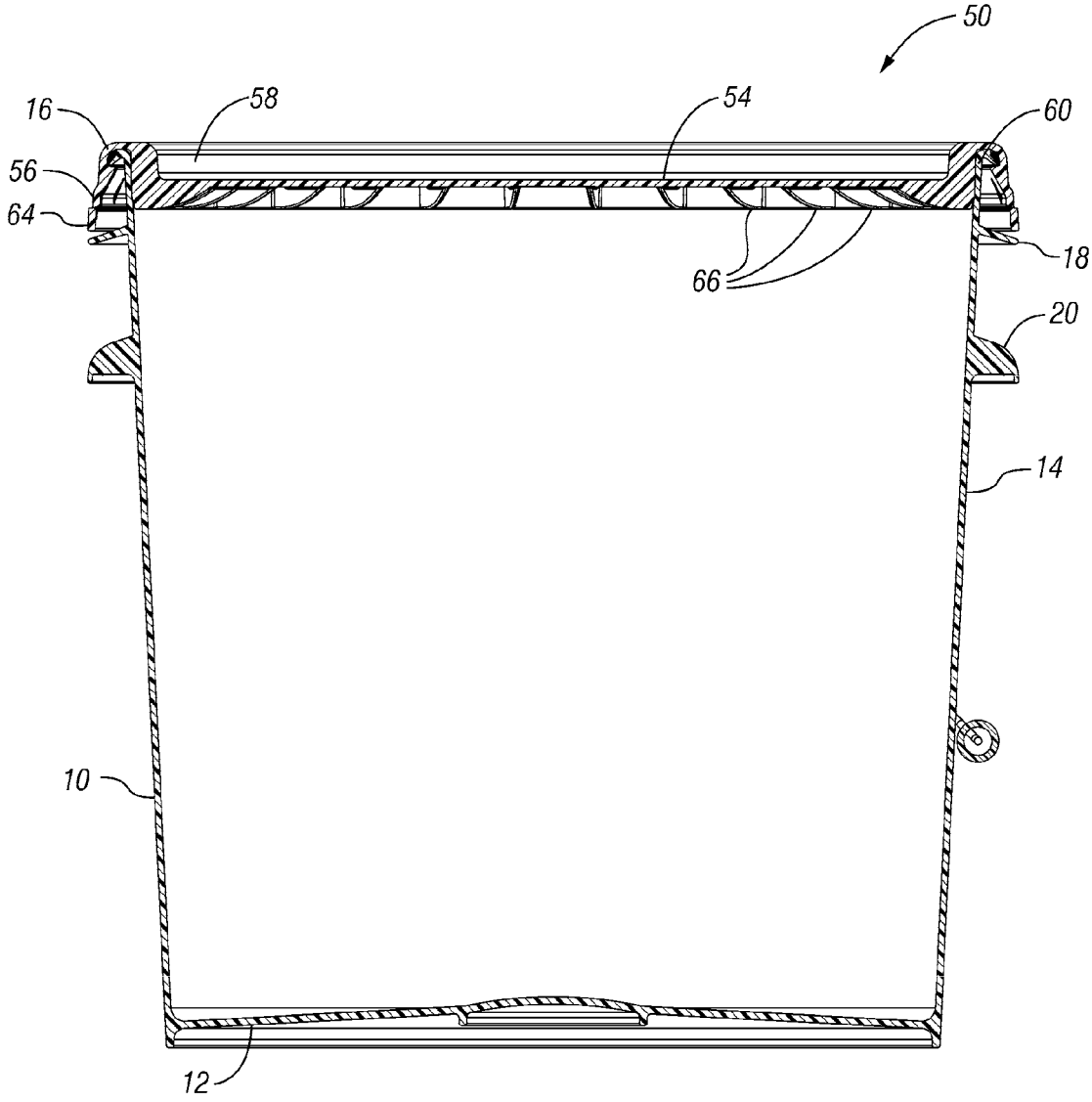
FIG. 10 is a section view taken along line B-B of FIG. 9.

FIG. 10 is a cross sectional view of the lid 50 on the pail 10 taken along line B-B of FIG. 9. A plurality of ribs 66 protrude downwardly from the circular lower wall 54 of the lid 50 and extend between the inner annular lip 58 and a middle annular lip 60 to reinforce both of them.

Figure 11:
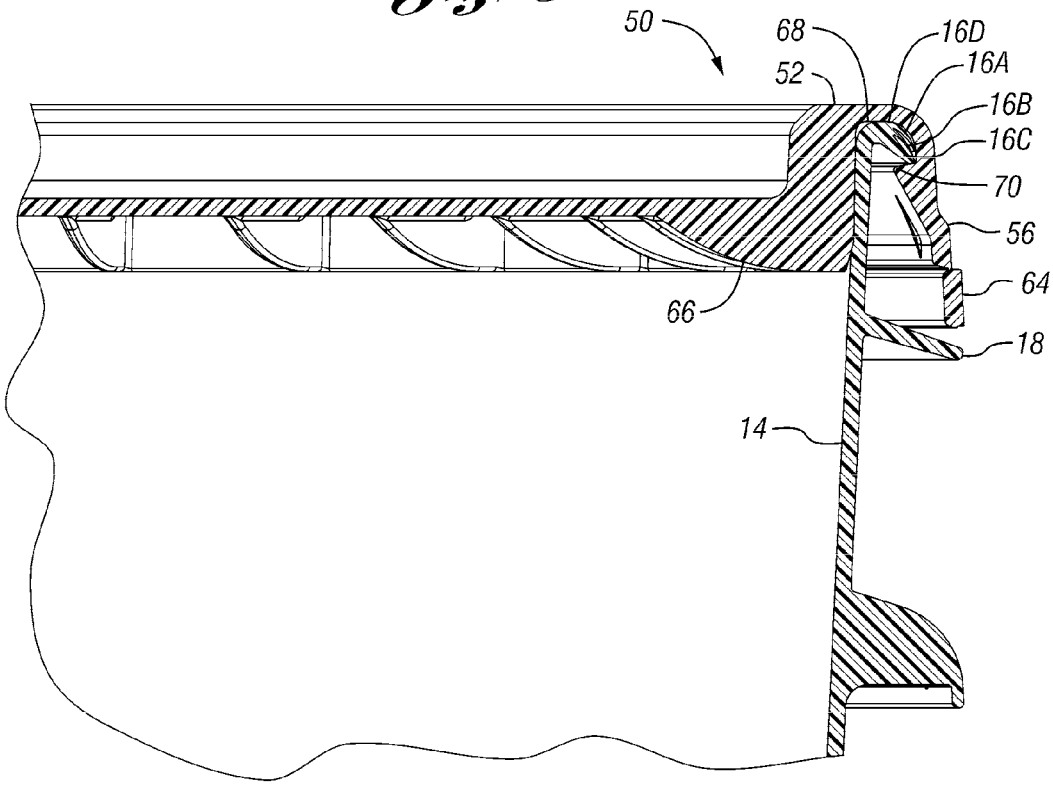
FIG. 11 is an enlarged view of a portion of FIG. 10.

FIG. 11 is an enlarged view of a portion of FIG. 10. The lid 50 includes a channel 68 extending around a periphery of the lid 50. When the lid 50 is located on the pail 10, flanges 16*a* and 16*b* are biased against the channel 68 to create a seal between the lid 50 and the pail 10. The flange 16*c* engages a ledge 70 adjacent the channel 68 to secure the lid 50 to the pail 10. The flange 16*c* may also contribute to sealing the lid 50 to the pail 10. The flange 16*c* and/or the ledge 70 may deform when the lid 50 is placed on the pail 10.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A pail comprising:

a base;

at least one wall extending upwardly from a periphery of the base to an opening of the pail; and a lip protruding outwardly from an upper edge of the at least one wall, the lip including an annular portion and a plurality of flanges extending radially outward from the annular portion, the plurality of flanges including at least one flexible flange.

2. The pail of claim 1 wherein at least one of the plurality of flanges extends from the annular portion substantially perpendicular to an outer surface of the at least one wall.

3. The pail of claim 1 wherein at least one of the plurality of flanges extends from the annular portion downwardly.

4. The pail of claim 1 wherein at least one of the plurality of flanges is substantially rigid.

5. The pail of claim 1 wherein the plurality of flanges are tapered at a radially outer edge.

6. The pail of claim 1 wherein a first flange of the plurality of flanges is thicker than a second flange of the plurality of flanges.

7. The pail of claim 1 wherein the plurality of flanges further includes a substantially rigid flange extending radially outwardly and downwardly from the annular portion.

8. The pail of claim 7 wherein the at least one flexible flange includes a first flange extending from the annular portion substantially perpendicularly to an outer surface of the at least one wall.

9. The pail of claim 8 wherein the at least one flexible flange further includes a second flange extending radially outwardly and downwardly from the annular portion between the first flange and the substantially rigid flange.

10. A pail assembly comprising:

a base;

at least one wall extending upwardly from a periphery of the base to an opening of the pail;

a lip extending from an upper edge of the at least one wall including a plurality of flanges, the plurality of flanges including a first flange that is flexible; and a lid over the opening of the pail, the lid located adjacent the plurality of flanges, the lid biasing the first flange downwardly.

11. The pail of claim 10 wherein at least one of the plurality of flanges is biased against the lid.

12. The pail assembly of claim 10 wherein the lid includes a tear-away strip.

13. The pail assembly of claim 10 wherein at least one of the plurality of flanges is substantially rigid.

14. The pail assembly of claim 13 wherein the at least one rigid flange engages a ledge on the lid to secure the lid to the pail.

15. The pail assembly of claim 10 wherein the lid includes a plurality of ribs.

16. A method of sealing a pail comprising:

a) placing a lid on an upper edge of the pail;

b) biasing the lid against a flexible flange located on the pail, thereby deflecting the flexible flange downwardly, and engaging at least one substantially rigid flange with a ledge on the lid.

17. The method as recited in claim 16 wherein the flexible flange extends from an annular portion of a lip on the upper edge of the pail.

18. The method as recited in claim 16 wherein the at least one substantially rigid flange extends radially outward from an upper edge of the pail below the flexible flange.

* * * * *